US008082958B2

(12) United States Patent
Engnell et al.

(10) Patent No.: US 8,082,958 B2
(45) Date of Patent: Dec. 27, 2011

(54) KNIVES AND KNIFE ASSEMBLIES

(75) Inventors: Mats Engnell, Iggesund (SE); Aaron J. Adent, Tampa, FL (US)

(73) Assignee: Iggesund Tools AB, Iggesund (SE)

( * ) Notice: Subject to any disclaimer, the term of this patent is extended or adjusted under 35 U.S.C. 154(b) by 27 days.

(21) Appl. No.: 12/257,988

(22) Filed: Oct. 24, 2008

(65) Prior Publication Data

US 2009/0133778 A1 May 28, 2009

(30) Foreign Application Priority Data

Oct. 24, 2007 (SE) ..... 0702365

(51) Int. Cl.
*B27C 1/00* (2006.01)
*B27G 13/08* (2006.01)
*B26D 1/14* (2006.01)

(52) U.S. Cl. ..... 144/176; 144/220; 144/230; 407/40; 407/47; 407/49

(58) Field of Classification Search ..... 144/162.1, 144/172, 174, 176, 218, 220, 241; 241/92, 241/189.1, 228.1, 296, 298; 407/40, 42, 407/47, 113–116, 49
See application file for complete search history.

(56) References Cited

U.S. PATENT DOCUMENTS

| | | | | |
|---|---|---|---|---|
| 6,058,989 | A | 5/2000 | LaGrange et al. | |
| 6,951,313 | B2 | 10/2005 | Frick et al. | |
| 6,968,879 | B2 * | 11/2005 | Schuh et al. | 144/174 |
| 7,140,408 | B1 * | 11/2006 | Hinchliff et al. | 144/241 |
| 7,159,626 | B2 * | 1/2007 | Biller et al. | 144/176 |
| 7,506,674 | B2 * | 3/2009 | Biller et al. | 144/176 |
| 7,677,282 | B2 * | 3/2010 | Stager | 144/241 |

* cited by examiner

*Primary Examiner* — Shelley Self
(74) *Attorney, Agent, or Firm* — Fitzpatrick, Cella, Harper & Scinto

(57) ABSTRACT

A knife includes first and second edges, a ridge, a concave surface, and a planar surface. The edges are defined by intersections of outer edge forming surfaces on an outer side of the knife and inner edge forming surfaces on an inner side of the knife. The ridge is on the inner side and the crest of the ridge is parallel to the first and second edges. The concave surface is between an inner edge forming surface and the ridge, and the planar surface is adjacent to the concave surface and between that first inner edge forming surface and the concave surface. A reference plane intersects the first and second edges, and a distance between any point on the concave surface and the reference plane is not less than a distance between any point on the planar surface and the reference plane.

27 Claims, 5 Drawing Sheets

KNIVES AND KNIFE ASSEMBLIES

BACKGROUND OF THE INVENTION

1. Field of the Invention

This invention relates generally to the forestry industry, and specifically to the field of woodworking machines. In particular, the invention relates to woodworking knives used in these machines, and to clamping assemblies that secure the knives.

2. Description of the Related Art

One of the main tasks in forestry industries is the processing of trees into finished wood products. Tree processing begins with harvesting live trees and cutting the trees into logs. Logs then are processed in various ways, according to the desired end product. Thus, forestry industry operations can be significantly affected by control over, and improvement upon, log processing steps and the machines used in these steps.

In the pulp or oriented strand board industries, logs are processed by machines designed to turn solid logs into chips or wafers. Examples of these machines include chippers (in both disc and drum forms), waferizers, and stranders. To perform their respective functions, these machines typically employ one or more knives mounted to a moving base such as, for example, a rotating disc or drum. Wood is processed by moving it into the path of the rotating knives, the blades of which contact the wood at a particular depth and orientation. This contact results in the formation of chips, shavings, wafers, or strands.

In the sawmill industry, logs are processed by machines designed to chip away certain portions of the logs to form rough lumber, with wood chips as a byproduct. Examples of these machines include chipper canters, chipper edgers, and chipper slabbers. Rough lumber can be further processed by planers to yield finished lumber, with wood shavings as a byproduct. All of these machines also employ knives, which are positioned to result in the formation of a cut or planed surface on the lumber.

In the veneer industry, logs are turned on veneer lathes to yield veneer sheets. These sheets can be used for manufacturing plywood or laminated veneer lumber. Veneer lathes also employ knives. However, in a lathe, wood is removed from a log not by repetitive contact of moving knives, but rather by bringing a rotating log into contact with a stationary knife mounted to the lathe.

Regardless of its use in a particular application, a woodworking knife can in time exhibit wear, resulting in dullness and even structural failure. Also, a worn knife may not cut wood effectively, resulting in wood chips or veneers having inconsistent size or shape. Thus, wood processing operations, such as a sawmills, seek to properly maintain their woodworking knives and, in particular, sharp knife edges.

Various methods for maintaining a sharp knife edge have been developed. In one method, a knife is removed from the machine, sharpened by grinding, and remounted to the machine. A disadvantage of this method is that, after grinding, the knife may have a different (and unwanted) size or shape. Thus, a knife sharpened this way usually requires careful positioning and aligning upon remounting to the woodcutting machine; knife alignment may be particularly important in machines having configurations of multiple knives. An incorrectly positioned knife tends to negatively affect the cutting properties of the machine, diminishing or canceling the effects of sharpening the knife. Also, grinding a knife edge to a precise and accurate shape can require costly, time-consuming techniques.

Another method for maintaining knife edges is the use of reversible knives. A reversible knife is manufactured with multiple edges (often two) and designed such that when one edge becomes worn from use, the knife can be removed from its mounting assembly, rotated or flipped about a symmetrical plane, and remounted, thereby exposing a fresh edge. Reversible knives are generally disposable: when all edges of a knife are worn, it is replaced with a new knife. This method overcomes the disadvantages inherent to grinding discussed above.

However, there are disadvantages to using reversible knives. Precise positioning of a reversible knife, whether upon initial mounting or reversal, can be difficult to achieve. Mounting is often done by hand; thus, the mounted position may be influenced by human error. Mounting errors can be exacerbated when a machine's knife mounts are not readily accessible, such as when mounts are located behind other components of the machine or when mounts are at a height difficult to reach. Moreover, in some applications reversible knives experience highly asymmetric and torsional loads. These loads can overcome the clamping forces holding knives to their mounts or cause knives to displace or fracture. U.S. Pat. Nos. 6,058,989 and 7,159,626 address some of these disadvantages.

U.S. Pat. No. 7,140,408 describes a reversible knife in which the chip guiding surface includes a reentrant portion. A feature of the knife that indexes a mounting assembly is located on this reentrant portion. This design is said to alleviate wear of the indexing feature when exposed to chip cutting. A disadvantage of this design occurs during chip forming and guiding. Chips cut by the knife edge are then guided along a chip guiding surface. However, when the chips reach the reentrant portion, they may lose contact with the knife until they have passed over the indexing feature. Once the indexing feature is passed, the knife has a deflecting ridge disposed at a large angle relative to the motion of the chips. As a result, the chips can fracture or splinter when hitting the deflector ridge. Also, the indexing feature of this knife is located at a significant distance from the cutting edge. Thus, if the knife is subject to a high amount of loads during cutting, the positioning of the indexing feature at a significant distance from the cutting edge may lead to breakage. That is, the distance of the indexing feature from the cutting edge creates a moment arm for forces applied to the cutting edge, which increases the stresses at the indexing feature. Further, the concave form of the indexing feature reduces the amount of structural material at this area of high stress, making it more prone to breakage. The thickness of the knife must be increased to compensate for this weakness. Although increasing the thickness of the knife can diminish torque breakage, this increases the material cost of the knife.

Another disadvantage of reversible knives is they tend to be manufactured from higher-quality materials and under stricter manufacturing tolerances than other woodcutting knives. While this yields durable knives with long-lasting sharp edges, it increases the costs of manufacturing the knives. In particular, the material cost can be significant. Thus, even a slight reduction in the amount of material in a reversible knife can result in a greatly reduced cost per knife. This can reduce the cost of operating woodcutting machines, particularly those configured to use multiple knives.

One way to reduce the amount of material in a reversible knife is to use a low-volume design. Such a design should have a compact form with small subsidiary surfaces, which are surfaces that are not directly utilized to cut, form, or guide chips. An example of a subsidiary surface is one that is used solely for clamping a knife to a mounting assembly. An example of a large (and disadvantageous) subsidiary surface is the indexing feature of the knife described in U.S. Pat. No. 7,140,408.

SUMMARY OF THE INVENTION

The invention includes knives, as well as assemblies for mounting knives. According to an example aspect of the invention, a knife includes a first edge, a second edge, a ridge, a concave surface, and a planar surface. The first edge is defined by an intersection of a first outer edge forming surface on the knife's outer side and a first inner edge forming surface on the inner side. The second edge is defined by an intersection of a second outer edge forming surface on the knife's outer side and a second inner edge forming surface on the inner side. The ridge is on the inner side of the knife and is positioned such that its crest is parallel to the first and second edges. The concave surface is between the first inner edge forming surface and the ridge. The planar surface is adjacent to the concave surface and between the concave surface and the first inner edge forming surface. A reference plane intersects the first and second edges. A distance between any point on the concave surface and the reference plane is not less than a distance between any point on the planar surface and the reference plane.

According to another example aspect of the invention, another knife includes a first edge, a second edge, and a ridge, all similar to those described above. This knife further includes a concave surface and a planar surface. The concave surface is between the first inner edge forming surface and the ridge. The planar surface is adjacent to the concave surface and between the concave surface and the first inner edge forming surface. A reference plane intersects the first and second edges. The dihedral angle between the planar surface and the reference plane is $\beta$, and an acute angle between any line tangent to the concave surface and the reference plane is not less than $\beta$.

According to yet another aspect of the invention, another knife includes a first cutting edge, a second cutting edge, a ridge, and a chip guiding surface. The first cutting edge is defined by an intersection of a first outer edge forming surface on an outer side of the knife and a first inner edge forming surface on the inner side. The second cutting edge is defined by an intersection of a second outer edge forming surface on the outer side and a second inner edge forming surface on the inner side. The ridge is on the inner side of the knife and is positioned such that its crest is parallel to the first and second cutting edges. The chip guiding surface is between the first inner edge forming surface and the ridge. The chip guiding surface includes a concave surface and a planar surface. The planar surface is between the first inner edge forming surface and the concave surface. Chips cut by the first cutting edge are guided along the chip guiding surface without any abrupt changes in direction during guiding.

According to still another aspect of the invention, a knife includes a first edge, defined by an intersection of a first outer edge forming surface on an outer side of the knife and a first inner edge forming surface on an inner side of the knife and a second edge, defined by an intersection of a second outer edge forming surface on the outer side and a second inner edge forming surface on the inner side. The knife further includes a ridge on the inner side, positioned such that the crest of the ridge is parallel to the first and second edges, a concave surface between the first inner edge forming surface and the ridge, and a planar surface adjacent to the concave surface and between the first inner edge forming surface and the concave surface. The planar surface is contiguous with and tangentially adjoining the concave surface.

Further features and advantages, as well as the structure and operation, of various example embodiments of the present invention are described in detail below with reference to the accompanying drawings.

BRIEF DESCRIPTION OF THE DRAWINGS

The features and advantages of the example embodiments of the invention presented herein will become more apparent from the detailed description set forth below when taken in conjunction with the drawings. Like reference numbers between two or more drawings indicate identical or functionally similar elements.

DETAILED DESCRIPTION OF THE EXAMPLE EMBODIMENTS

The description of the example embodiments below and the background above refer to the processing and cutting of a particular material, namely wood. However, those having skill in the relevant art will recognize that wood is simply one material that may be suitable for use with the present invention. Therefore, any references to wood shall be understood as examples rather than limitations.

The description below also contains references to chipper knives. While the present invention certainly contemplates woodchipping, this is merely an example of the broader category of wood processing to which this invention is directed. Those having skill in the art will recognize that this invention encompasses knives other than those used specifically for woodchipping. For example, this invention contemplates knives suitable for use in rotary lathes.

Figure 1:
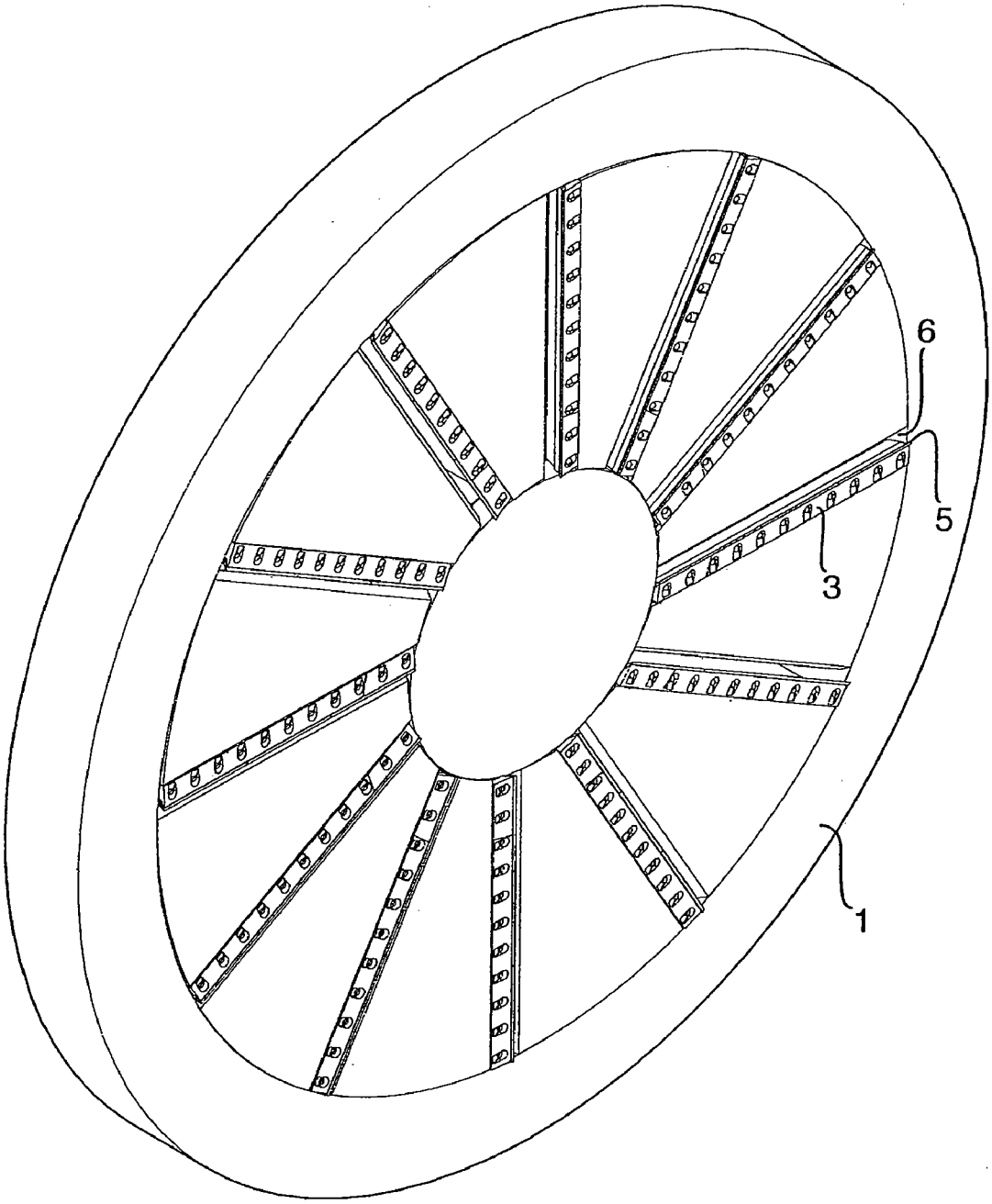
FIG. 1 is a perspective view of a rotary disc cutting head.
Figure 2:
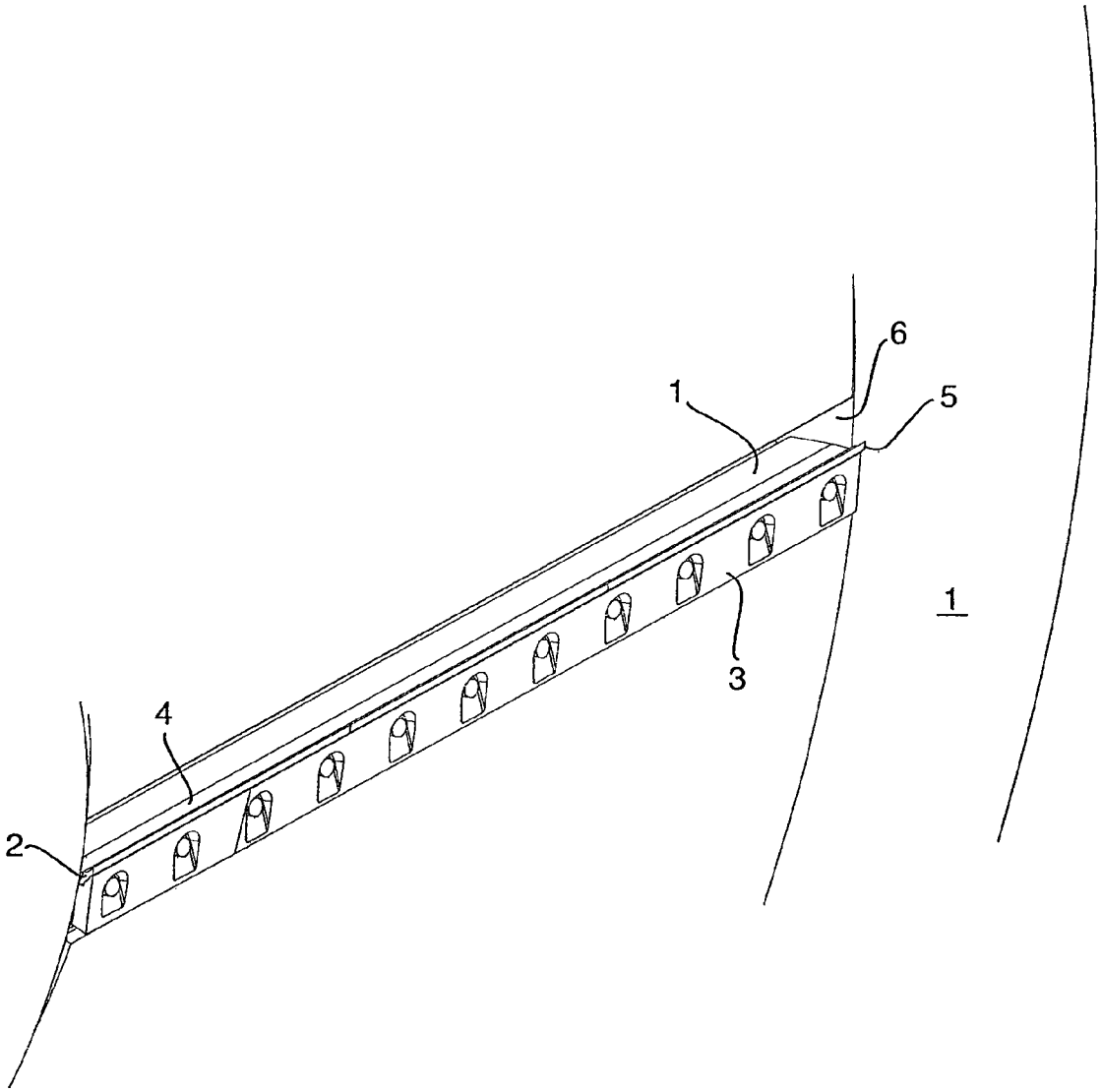
FIG. 2 is an enlarged perspective view of the cutting head of FIG. 1 showing one row of chipper knives.

FIGS. 1 and 2 show various perspective views of a front side of an example rotary disc cutting head 1. Cutting head 1 can function as a woodchipping component of a wood processing machine. As shown in FIG. 1, cutting head 1 includes several rows of chipper knives, each row extending radially from the center of the cutting head. In the view of FIG. 1, only the cutting edge 5 of each knife is visible; the remainder of the knife is clamped between outer clamping member 3 and inner clamping member 4. Each radial row includes three chipper knives (as more clearly illustrated in FIG. 2), which are mounted to the cutting head adjacent to a slot 6. In operation, the cutting head receives wood for chipping from a feed chute (not shown). The cutting head rotates, causing the cutting edges 5 of the chipper knives to separate chips of a desired length and thickness from the wood. Chips cut from the wood are then passed from the front side of the cutting head via the slots. FIG. 2 shows an enlarged view of a radial row of mounted chipper knives 2. In the view of FIG. 2, again only the cutting edge 5 of each knife is visible.

Figure 3:
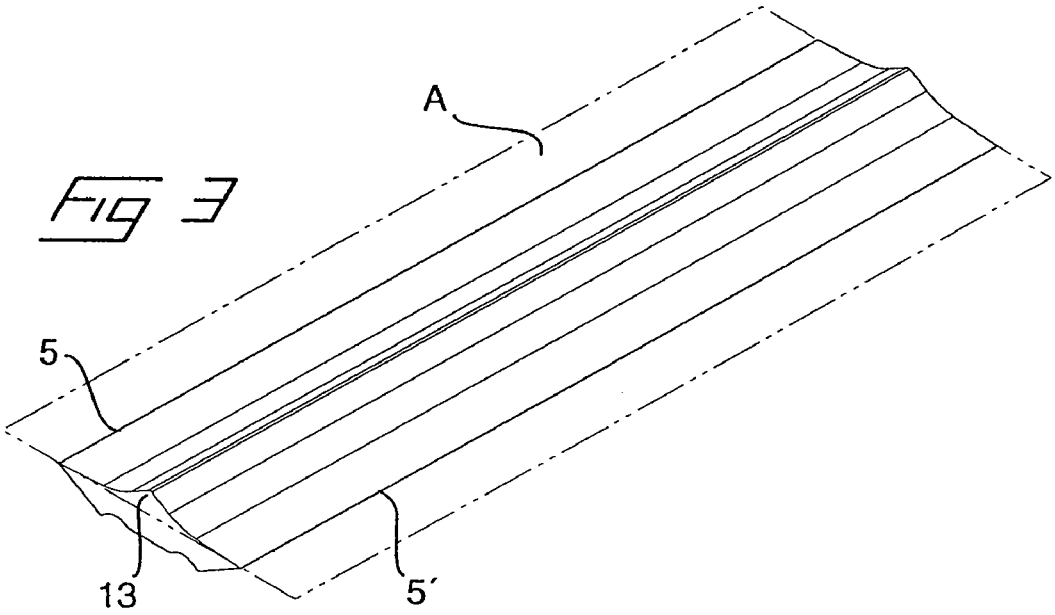
FIG. 3 is a perspective view of an inner side of a chipper knife according to an example embodiment of the invention.
Figure 4:
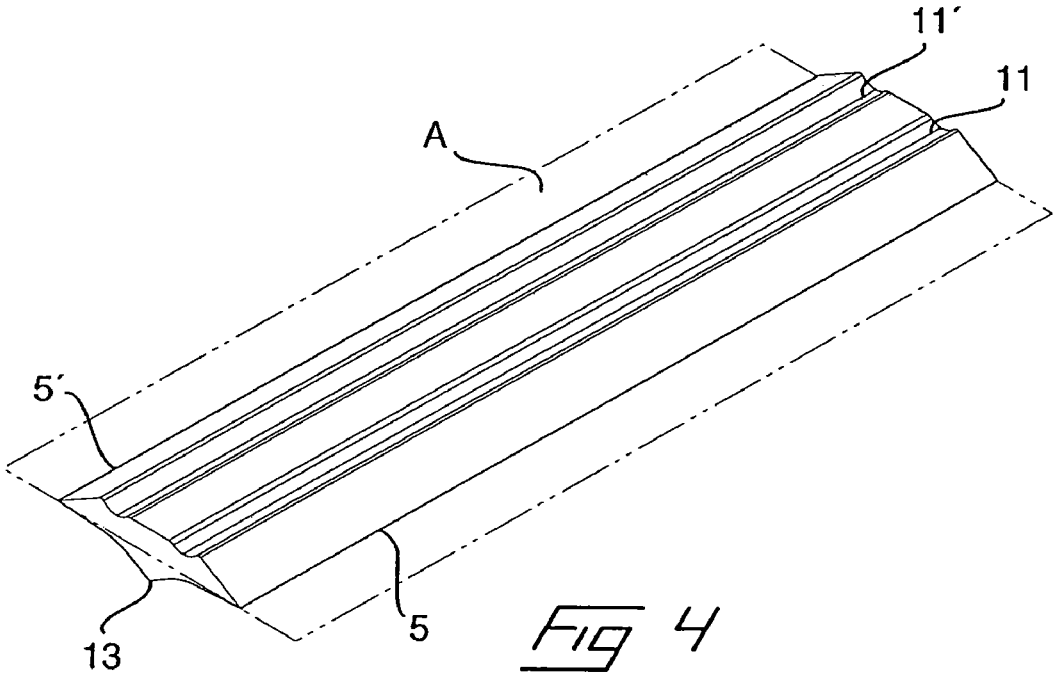
FIG. 4 is a perspective view of an outer side of a chipper knife according to an example embodiment of the invention.
Figure 5:
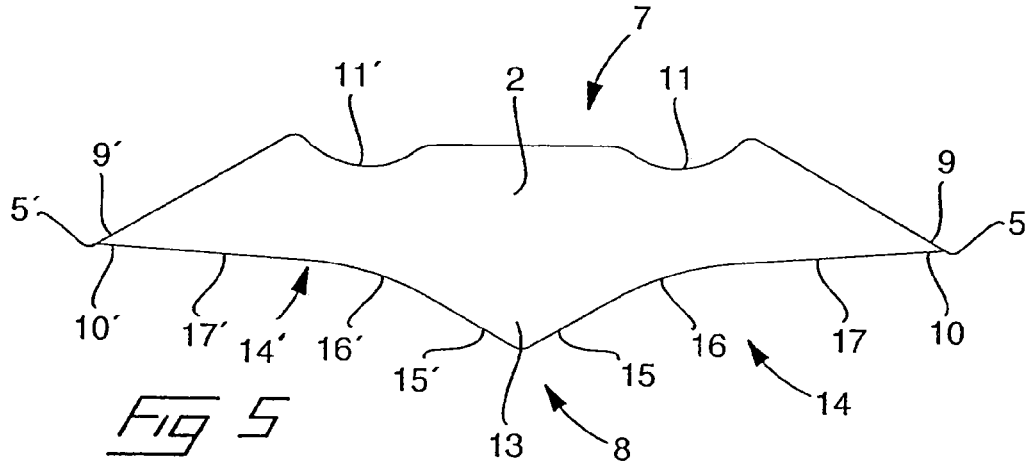
FIG. 5 is a cross-sectional view of a chipper knife according to an example embodiment of the invention.

A chipper knife according to an example embodiment of the invention will now be described with reference to FIGS. 3-5. FIG. 5 shows a cross-sectional view of a chipper knife 2, including outer side 7 and inner side 8. FIG. 3 shows a perspective view of the inner side of the knife shown in FIG. 5, while FIG. 4 shows a perspective view of its outer side. In various example embodiments of the invention, when mounted to a cutting head, the outer side of the knife can contact an outer clamping member and the inner side can contact an inner clamping member. In this configuration, the outer side faces wood pieces fed into the chipping apparatus, while the inner side can guide cut chips inward through a slot (such as slot 6 of FIGS. 1 and 2). This configuration is described in further detail below.

Figure 8:
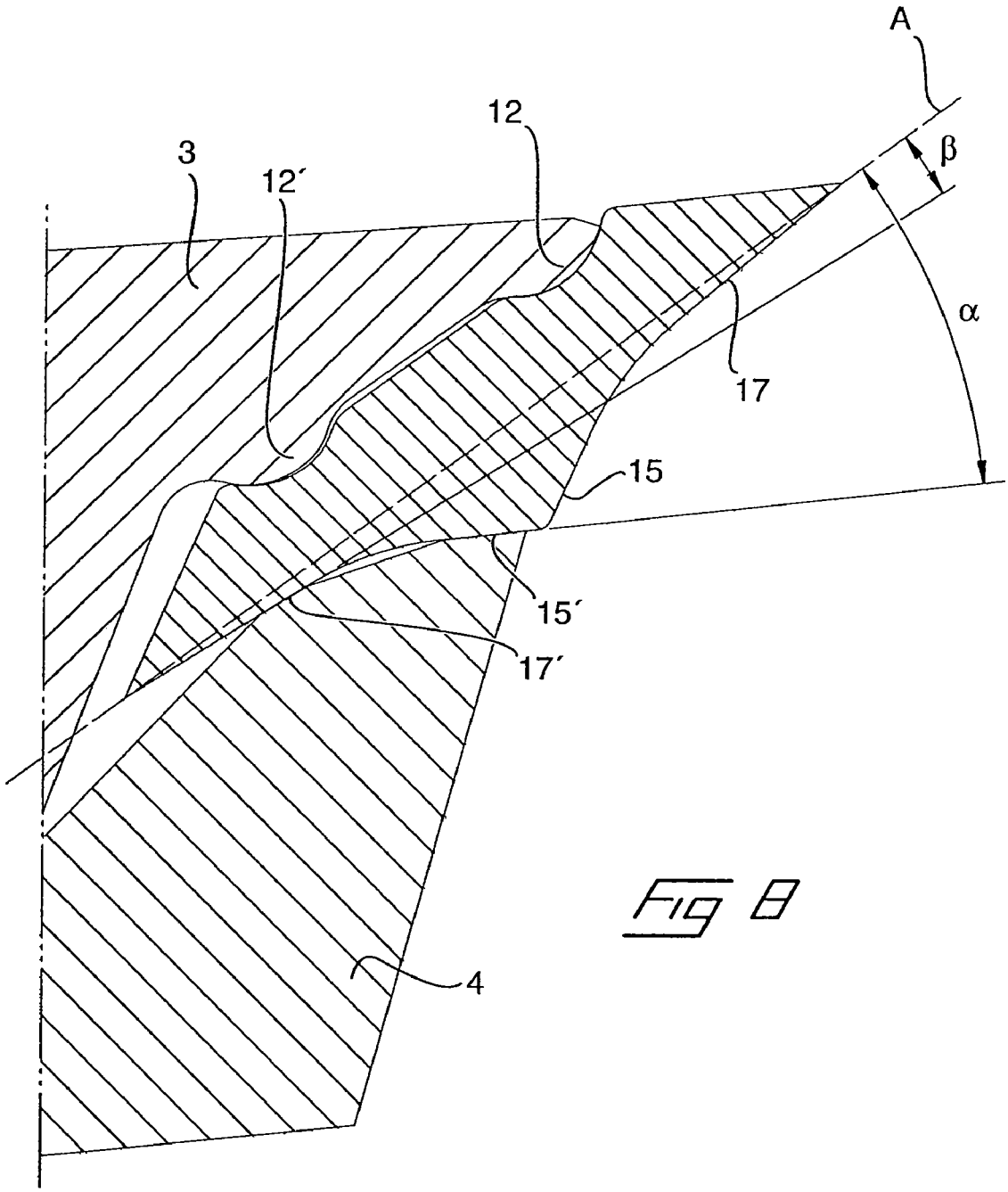
FIG. 8 is an enlarged cross-sectional view of a mounted chipper knife.

The inner side 8 of the chipper knife 2 includes two cutting edges 5 and 5' and a deflector ridge 13, which is equidistant from and parallel to the cutting edges 5 and 5'. The knife is symmetrical about a plane that passes through the deflector ridge 13 and that is perpendicular to a reference plane A, which passes through the cutting edges (as shown in FIG. 8). Each cutting edge 5, 5' is defined by an outer edge forming surface 9, 9' and an inner edge forming surface 10, 10'. These edge forming surfaces can be planar, though they need not be.

On either side of the deflector ridge 13 is a chip guiding surface 14, 14'. Each chip guiding surface 14, 14' includes a first contact surface 15, 15', a deflecting surface 16, 16', and a second contact surface 17, 17'. Deflecting surface 16, 16' is concave with respect to the body of the knife. The first contact surface 15, 15' is adjacent to the crest of the deflector ridge 13 and the second contact surface 17, 17' is adjacent to the inner edge forming surface 10, 10'. The deflecting surface 16, 16' is between the first and second contact surfaces. Thus, the chip guiding surface 14, 14' extends from the inner edge forming surface 10, 10' to the crest of the deflector ridge 13, and the deflector ridge divides the inner side 8 of the chipping knife into two symmetrical chip guiding surfaces 14 and 14'. In an embodiment of the invention, the first contact surfaces 15 and 15' and the second contact surfaces 17 and 17' all are preferably planar, as illustrated in FIG. 5.

In an example embodiment of the invention, a cross-section of the chip guiding surface 14, 14' (as shown in FIG. 5) is continuously either planar or concave. That is, this surface includes neither discontinuities nor convex surfaces. Moreover, in this embodiment, the second contact surface 17, 17' is continuous with the inner edge forming surface 10, 10', such that there is no distinguishable boundary between the two surfaces. Thus, the chip guiding surface 14, 14' continuously extends from the inner edge forming surface 10, 10' to the crest of the deflector ridge 13 without any intermediate discontinuities or convex surfaces. Such a continuous surface can result in higher quality chips because, in the absence of abrupt angular changes, chips may be less likely to break or deform while guided away from the cutting edge.

The inner side of a chipper knife according to the present invention is not limited to the foregoing description. For example, the chip guiding surface need not be continuous with the edge forming surface. Rather, the edge forming surface may be raised above the chip guiding surface, leading to a discontinuity between the two, a feature discussed in PCT International Publication Nos. WO 2008/085111 and WO 2008/085112. In this case, the chip guiding surface may begin at some distance from the cutting edge. As another example, the radius of curvature of the deflector ridge, i.e., the curvature on either side of the crest of the deflector ridge, can vary from that illustrated in FIG. 5. Although a smaller radius may allow for a reduced distance from one cutting edge to another, and thus an overall shortening of the cross-section of the knife, design constraints or other considerations may require a chipper knife having a deflector ridge with a larger radius of curvature.

Figure 6:
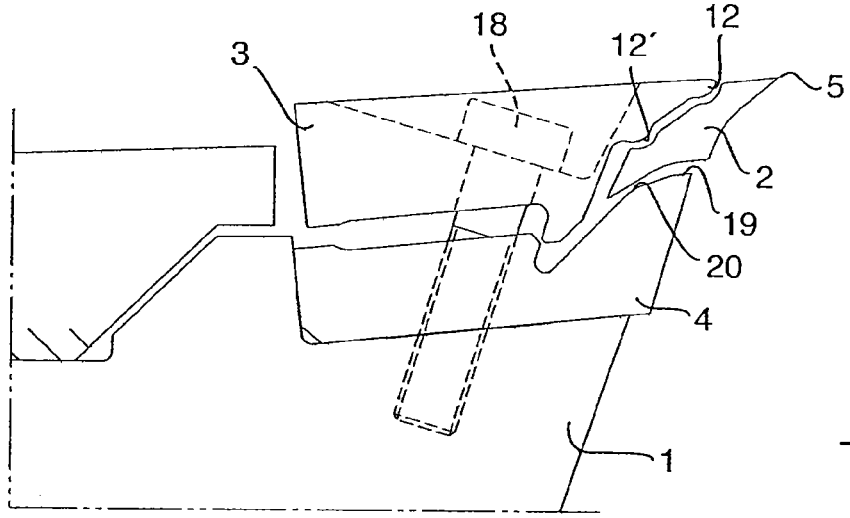
FIG. 6 is a cross-sectional view of a chipper knife dismounted from inner and outer clamping members of a cutting head.
Figure 7:
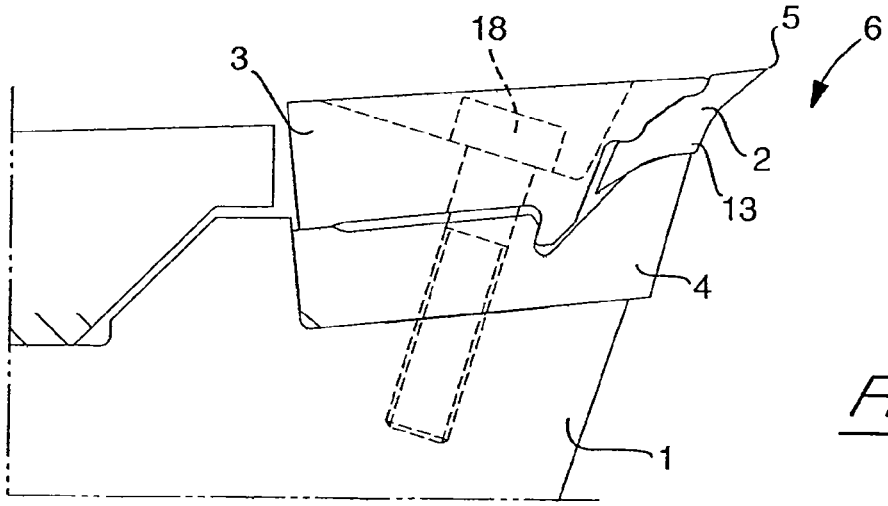
FIG. 7 is a cross-sectional view of a chipper knife mounted to inner and outer clamping members of a cutting head.

FIGS. 6-8 are cross-sectional views illustrating the mounting of a chipper knife to a cutting head. FIG. 6 shows a chipper knife 2 unmounted from an inner clamping member 4 and an outer clamping member 3. FIGS. 7 and 8 show the knife clamped between the clamping members, and thus mounted to the cutting head 1. In various example embodiments of the invention, a knife assembly includes inner clamping member 4 and outer clamping member 3. As further shown in FIG. 6, the inner clamping member 4 can include a first mounting surface 19 and a second mounting surface 20. These mounting surfaces are described in further detail below.

The chipper knife 2 can include a setting portion for engaging the knife with the outer clamping member 3. Referring to FIGS. 4 and 5, the outer side 7 of the knife can include a pair of parallel grooves 11 and 11', which can be configured to engage with corresponding engaging portions on the outer clamping member 3. Features for engaging a knife with respect to a clamping assembly are described further in U.S. Pat. No. 7,159,626, which is hereby incorporated by reference herein. As shown in FIG. 6, corresponding engaging portions on the outer clamping member 3 are parallel ridges 12 and 12'. Those skilled in the relevant art will recognize that suitable designs for the engaging portions, both those on the outer side of the knife and those on the outer clamping member, are not limited to the design shown. Rather, suitable designs are any that provide support to the'chipper knife and limit the knife's displacement with respect to the outer clamping member.

Mounting of the chipper knife 2 to the cutting head 1 can proceed as follows. The knife can be clamped between the clamping members 3 and 4 by clamping means, an example of which is screw bolt 18. Tightening of the screw bolt 18 causes the clamping members to be forced together, as illustrated in FIG. 7. When the clamping members are forced together, a portion of the outer side 7 of the knife can contact with outer clamping member 3 such that parallel grooves 11 and 11' engage with parallel ridges 12 and 12'. Furthermore, a portion of the inner side 8 of the knife can contact with the inner clamping member 4 such that first and second contact surfaces 15' and 17' contact first and second mounting surfaces 19 and 20, respectively. In various example embodiments of the invention, the topography of a mounting surface of the inner clamping member can match the topography of the contact surface to which it contacts. For example, first contact surface 15' and first mounting surface 19 both can be planar. However, a contact surface of the knife and its corresponding mounting surface need not match in form.

In the mounting configuration illustrated in FIGS. 6-8, cutting edge 5 is in a cutting position and chip guiding surface 14 is configured to guide chips. However, the knife is reversible. Owing to its symmetrical design, it can also be mounted with cutting edge 5' in a cutting position and chip guiding surface 14' configured to guide chips. Thus, contact surface 15, 15' can function both as part of a larger chip guiding surface and as a contact surface for mounting. Similarly, contact surface 17, 17' also can function both as part of a chip guiding surface and as a contact surface.

In the embodiment of the invention described above, the inner clamping member contacts the inner side of the chipping knife at two areas: the first and second contact surfaces. These contact surfaces are spatially oriented at different angles with respect to one another. This kind of contact between the knife and the clamping member provides a more secure mounting of the knife than a single area of contact. Moreover, the illustrations of this embodiment show the first contact surface positioned close to the crest of the deflector ridge and the second contact surface positioned close to the cutting edge. Such a positioning and spatial separation of the contact surfaces may further increase stability of the knife mount.

As illustrated in FIGS. 7 and 8, a chipper knife can be reversible. That is, when it is mounted to a cutting head, one cutting edge and one chip guiding surface are exposed for cutting and guiding chips, while another cutting edge and another guiding surface, in combination with a portion of the upper side of the knife, are used to mount the knife to the cutting head via outer and inner clamping members. One aspect of this reversible knife is that the features of the chip guiding surface that allow the inner side of the knife to securely contact an inner clamping member can be the same features that result in high quality chips when used for chip guiding. Thus, a chipper knife's chip guiding surfaces may have no (or few) features configured solely for knife mounting. As a result, the cross-sectional length of a chip guiding surface can be reduced, thereby reducing the overall size of the chipper knife and the amount of material needed to produce it.

FIG. 8 also illustrates angular values associated with various embodiments of the invention, in which first contact surface 15' and second contact surface 17' both are planar. In these embodiments, certain angles are determined with reference to a cross-section of the knife. $\alpha$ is the dihedral angle between the plane of the first contact surface 15' and the reference plane A, which passes through the cutting edges of the chipper knife. $\beta$ is the dihedral angle between the plane of the second contact surface 17' and the plane A. Moreover, in various embodiments of the invention, $\alpha>\beta$.

Also referring to FIG. 8, the acute angle between any line tangent to the concave surface (positioned between surfaces 15' and 17') and plane A is not greater than $\alpha$. In fact, for any point on the concave surface, the acute angle between a line tangent to that point and plane A must be both not greater than $\alpha$ and not less than $\beta$.

For knives having a symmetric cross-section, $\alpha$ also is the dihedral angle between the plane of the contact surface 15 and the plane A, and $\beta$ also is the dihedral angle between the contact surface 17 and the plane A. In embodiments of the invention where the first and second mounting surfaces 19 and 20 are planar, when the knife is mounted (that is, when the first and second contact surfaces of the knife contact the first and second mounting surfaces of the inner clamping member), $\alpha$ also is the dihedral angle between the surface 19 and plane A, and $\beta$ also is the dihedral angle between the surface 20 and plane A.

One aspect of the invention is that knives with relatively low values of $\alpha$ and $\beta$ can be manufactured under less strict tolerances and with less precision. Although less precise manufacturing can result in knives that deviate from the ideal design, these knives can still be suitable for use in wood processing. An example manufacturing deviation occurs when the center between parallel grooves 11 and 11' is not exactly opposite the deflector ridge 13 (that is, the plane passing through the deflector ridge and a line centered between the parallel grooves is not exactly perpendicular to reference plane A). The inner and outer clamping members can accommodate such a deviation: the parallel grooves will align as usual to the engaging portion of the outer clamping member and the knife will contact the inner clamping member at a slightly displaced position. With the design as described displacement from the usual mounting position can still result in a secure mount with few detrimental effects. Another example deviation occurs not from manufacturing but from use: a chip guiding surface can become worn when its associated cutting edge is used to process wood. Because the surface is worn, changes can result to the first and second contact surfaces. Again, by adopting low values for $\alpha$ and $\beta$, the planar contact surface are less prone to wear and, accordingly, the knife is less susceptible to being incorrectly seated or secured when subsequently turned.

Certain angular ranges (and values) of $\alpha$ and $\beta$ are preferable for accommodating deviations. In general, $\alpha$ is preferably (but not necessarily) less than 50°; more preferably, $\alpha$ is less than 40° and even more preferably, it is less than 30°. Most preferred values of $\alpha$ and $\beta$ are 29° and 4°, respectively.

With the knife so designed, there are no abrupt changes in direction along the chip guiding surface 14, 14'. In chipping operations, for example, chips cut by cutting edge 5, 5' will be guided along chip guiding surface 14, 14' without meeting any abrupt changes in direction. Therefore, the chips will not be prone to splintering as they would when encountering an abrupt change in guiding direction. In some preferred designs, the chips will be guided so as to be in substantially continuous contact with the chip guiding surface 14, 14' during guiding.

In one embodiment, contact surfaces 15, 15' and 17, 17' can be considered to be tangential to the curve of deflecting surface 16, 16' at the points where the contact surfaces 15, 15' and 17, 17' meet deflecting surface 16, 16'. That is, the contact surfaces 15, 15' and 17, 17' can be said to be contiguous with and tangentially adjoining deflecting surfaces 16, 16'.

In the foregoing description, example aspects of the present invention are described with reference to specific example embodiments. Despite these specific embodiments, many additional modifications and variations will be apparent to those skilled in the art. Thus, the example embodiments of the invention may be practiced in ways other than those specifically described. For example, although some embodiments of the invention may have been described in the context of knives suitable for use in woodchipping machines, in practice embodiments also may include knives used in other woodworking machines, such as veneer lathes. Accordingly, the specification shall be regarded as illustrative rather than restrictive, and modifications and changes thereto do not depart from its broader spirit and scope.

Similarly, the figures are presented solely for the purpose of providing illustrative examples. The example embodiments presented herein are sufficiently flexible and configurable such that the invention may be practiced in ways other than those shown in the figures.

Furthermore, the processes recited in the claims need not be performed in the order presented.

This application claims the benefit under 35 U.S.C. §119 of Swedish Patent Application No. 0702365-8 filed Oct. 24, 2007, the entire contents of which are hereby incorporated herein.

What is claimed is:

1. A wood chipping knife comprising:

a knife body having an inner side and an outer side, said body having a first edge, defined by an intersection of a first outer edge forming surface on the outer side of the knife and a first inner edge forming surface on the inner side of the knife;

a second edge, defined by an intersection of a second outer edge forming surface on the outer side of the knife and a second inner edge forming surface on the inner side of the knife;

a ridge on said inner side of the knife, said ridge projecting from said inner side and terminating in a crest; said ridge being positioned such that the crest of the ridge is parallel to the first and second edges;

a concave surface portion on said inner side of the knife between the first inner edge forming surface and the crest of the ridge; and a flat planar surface portion on said inner side of the knife adjacent to the concave surface portion and located between the first inner edge forming surface and the concave surface, said first and second edges of the knife each being located on a reference plane which intersects the first and second edges;

said flat planar surface portion forming a dihedral acute angle to and extending outward from, said reference plane;

said concave surface tangentially joining said flat planar surface portion and curving outward therefrom away from the reference plane, and wherein the distance between any point on the concave surface portion on the inner side of the knife and the reference plane measured perpendicular to the reference plane and towards the inner side of the knife body is not less than a distance between any point on the flat planar surface and the reference plane, whereby the concave surface portion is exposed to wood chip flow during use to provide a chip guiding function during use.

2. A knife according to claim 1, wherein the knife includes a second flat planar surface portion on said inner side of the knife which is located between the concave surface and the crest of the ridge.

3. A knife according to claim 2, wherein the second flat planar surface portion and the reference plane define a dihedral acute angle $\alpha$ and $\alpha$ is less than 50° whereby the concave surface portion is exposed to chip flow during use.

4. A knife according to claim 1, further comprising a clamp setting portion on the outer side of the knife body.

5. A knife according to claim 1, wherein the first flat planar surface portion has no distinguishable boundary with the first inner edge forming surface.

6. A knife according to claim 1, wherein the knife is symmetrical about a plane which passes through the ridge and is perpendicular to the reference plane.

7. A wood chipping knife comprising:

a knife body having an inner side and an outer side, said body having a first edge, defined by an intersection of a first outer edge forming surface on the outer side of the knife and a first inner edge forming surface on the inner side of the knife;

a second edge, defined by an intersection of a second outer edge forming surface on the outer side of the knife and a second inner edge forming surface on the inner side of the knife;

a ridge on said inner side of the knife, said ridge projecting from the inner side and terminating in a crest; said ridge being positioned such that the crest of the ridge is parallel to the first and second edges;

a concave surface portion on the inner side of the knife between the first inner edge forming surface and the crest of the ridge; and a flat planar surface portion on the inner side of the knife adjacent to the concave surface portion and located between the first inner edge forming surface and the concave surface portion, said first and second edges of the knife being located on a reference plane which intersects the first and second edges;

said concave surface portion tangentially joining said flat planar surface portion and curving outward therefrom away from said reference plane;

said flat planar surface portion and said reference plane and said planar surface being located to define a dihedral acute angle $\beta$ between the flat planar surface portion and the reference plane whose apex lies on the reference plane at said first edge, whereby the flat planar surface portion extends away from the reference plane and wherein an acute angle between any line tangent to the concave surface and the reference plane is not less than $\beta$, whereby the concave surface portion is exposed to wood chip flow during use to provide a chip guiding function during use.

8. A knife according to claim 7, wherein the knife includes a second planar surface on the inner side of the knife located between the concave surface and crest of the ridge.

9. A knife according to claim 8, wherein the second planar surface defines a dihedral acute angle $\alpha$ between the second planar surface and the reference plane on the inner side of the knife, and $\alpha$ is less than 50°.

10. A knife according to claim 7, further comprising a clamp setting portion on the outer side of the knife body.

11. A knife according to claim 7, wherein the first planar surface has no distinguishable boundary with the first inner edge forming surface.

12. A knife according to claim 7, wherein the knife is symmetrical about a plane which passes through the ridge and is perpendicular to the reference plane.

13. A wood chipping knife comprising:

a knife body having an inner side and an outer side, said body having a first cutting edge, defined by an intersection of a first outer edge forming surface on the outer side of the knife and a first inner edge forming surface on the inner side of the knife;

a second cutting edge, defined by an intersection of a second outer edge forming surface on the outer side of the knife and a second inner edge forming surface on the inner side of the knife;

a ridge on said inner side of the knife, said ridge projecting from said inner side and terminating in a crest; said ridge being positioned such that the crest of the ridge is parallel to the first and second cutting edges; and a chip guiding surface on the inner side of the knife between the first inner edge forming surface and the ridge, said chip guiding surface including a concave surface portion and a flat planar surface portion, said flat planar surface portion being located between the first inner edge forming surface and the concave surface portion;

said first and second cutting edges of the knife each being located on a reference plane which intersects said first and second cutting edges;

said flat planar surface portion forming a dihedral acute angle $\beta$ to and extending outward from said reference plane;

said concave surface portion tangentially joining said flat planar surface portion and curving outwardly therefrom towards said crest; and wherein the distance between any point on the concave surface portion and the reference plane measured perpendicular to the reference plane and towards the inner side of the knife body is not any less than a distance between any point on the flat planar surface and the reference plane;

whereby the concave surface portion is exposed to chip flow during use and chips cut by the first cutting edge are guided along the chip guiding surface without any abrupt changes in direction during guiding.

14. A knife according to claim 13, wherein the chips remain in substantially continuous contact with the chip guiding surface during guiding.

15. A knife according to claim 13, including a second planar surface portion located on said ridge between the concave surface and said crest.

16. A knife according to claim 13, including a second chip guiding surface located between the second inner edge forming surface and the crest of the ridge, said second chip guiding surface including a concave surface portion located between two flat planar surfaces, one of which is located between said second cutting edge and said second chip guiding surface and the other of which is located on said ridge between said crest and said second chip guiding portion.

17. A knife according to claim 13, further comprising a setting portion on the outer side of the knife.

18. A knife according to claim 13, wherein the first planar surface has no distinguishable boundary with the first inner edge forming surface.

19. A knife according to claim 13, wherein the knife is symmetrical about a plane that passes through the ridge and that is perpendicular to a reference plane intersecting the first and second cutting edges.

20. A wood chipping knife comprising:

a knife body having an inner side and an outer side, said body having a first cutting edge, defined by an intersection of a first outer edge forming surface on the outer side of the knife and a first inner edge forming surface on the inner side of the knife;

a second cutting edge, defined by an intersection of a second outer edge forming surface on the outer side and a second inner edge forming surface on the inner side;

a ridge on the inner side of the knife, said ridge projecting from said inner side and terminating in a crest, said ridge being positioned such that the crest of the ridge is parallel to the first and second edges;

first and second chip guiding surfaces formed on said inner side of the knife body on opposite sides of the ridge, each of said chip guiding surfaces including a concave surface portion between the inner edge forming surface on its side of the ridge and the ridge, and a first flat planar surface portion adjacent to its concave surface portion and located between the inner edge forming surface on its side of the ridge and its concave surface portion, said first and second cutting edges of the knife each being located on a reference plane which intersects the first and second cutting edges;

said flat planar surface portions forming a dihedral acute angle $\beta$ to and extending outwardly from, said reference plane, said concave surface portions tangentially joining the flat planar surface portions adjacent thereto on its side of the ridge and curving outwardly therefrom away from the reference plane and wherein the distance between any point on the concave surface portions on the inner side of the knife and the reference plane measured perpendicular to the reference plane and towards the inner side of the knife body is not less than a distance between any point on the flat planar surfaces and the reference plane, whereby the flat planar surface portions of each of the chip guiding surfaces is contiguous with and tangentially adjoining its adjacent concave surface portion and the concave surface portions are exposed to wood chip flow during use to provide a chip guiding function during use.

21. A knife according to claim 20, wherein each of said chip guiding surfaces includes a second flat planar surface portion between its concave surface portion and the crest of the ridge.

22. A knife according to claim 21, wherein said second flat planar portions form a dihedral acute angle $\alpha$ to and extending outwardly from said reference plane that is less than 50°.

23. A knife according to claim 21, wherein each of said second planar surface portions is contiguous with and tangentially adjoining its adjacent concave surface portion.

24. A knife according to claim 20 or claim 21, wherein an acute angle between any line tangent to the concave surface portions and the reference plane is not less than the dihedral angle formed between said first flat planar surface portions and said reference plane.

25. A knife according to claim 20, wherein the knife is symmetrical about a plane that passes through the ridge and that is perpendicular to the reference plane.

26. A wood chipping knife and clamping assembly comprising:

a knife body having an inner side and an outer side, said body having a first edge, defined by an intersection of a first outer edge forming surface on the outer side of the knife and a first inner edge forming surface on the inner side of the knife;

a second edge, defined by an intersection of a second outer edge forming surface on the outer side of the knife and a second inner edge forming surface on the inner side of the knife;

a ridge on said inner side of the knife, said ridge projecting from said inner side and terminating in a crest; said ridge being positioned such that the crest of the ridge is parallel to the first and second edges;

a concave surface on said inner side of the knife between the first inner edge forming surface and the crest of the ridge; and a flat planar surface portion on said inner side of the knife adjacent to the concave surface and located between the first inner edge forming surface and the concave surface, said first and second edges of the knife each being located on a reference plane which intersects the first and second edges, said flat planar surface portion forming a dihedral acute angle to and extending outward from said reference plane, said concave surface tangentially joining said flat planar surface and curving outward therefrom away from the reference plane, and wherein the distance between any point on the concave surface portion on the inner side of the knife and the reference plane measured perpendicular to the reference plane and towards the inner side of the knife body is not less than a distance between any point on the flat planar surface and the reference plane, whereby the concave surface portion is exposed to wood chip flow during use to provide a chip guiding function during use;

and a clamping assembly including an outer clamping member having a knife engaging means for engaging the outer side of the knife body and determining the position of the knife with respect to the outer clamping member; and an inner clamping member having at least one mounting surface, wherein the at least one mounting surface contacts the flat planar surface on the inner side of the knife.

27. A wood chipping knife and clamping assembly comprising:

a knife body having an inner side and an outer side, said body having a first edge, defined by an intersection of a first outer edge forming surface on the outer side of the knife and a first inner edge forming surface on the inner side of the knife;

a second edge, defined by an intersection of a second outer edge forming surface on the outer side of the knife and a second inner edge forming surface on the inner side of the knife;

a ridge on said inner side of the knife, said ridge projecting from the inner side and terminating in a crest; said ridge being positioned such that the crest of the ridge is parallel to the first and second edges;

a concave surface portion on the inner side of the knife between the first inner edge forming surface and the crest of the ridge; and a flat planar surface on the inner side of the knife adjacent to the concave surface portion and located between the first inner edge forming surface and the concave surface, said first and second edges of the knife being located on a reference plane which intersects the first and second edges;

said flat planar surface portion forming a dihedral acute angle to and extending outward from, said reference plane;

said concave surface tangentially joining said flat planar surface and curving outward therefrom away from said reference plane;

said dihedral acute angle between the reference plane and said flat planar surface portion defining a dihedral acute angle $\beta$ whose apex lies on the reference plane at said first edge, whereby an acute angle between any line tangent to the concave surface and the reference plane is not less than $\beta$ and the concave surface portion is exposed to wood chip flow during us to provide a chip guiding function during use;

and a clamping assembly including an outer clamping member having a knife engaging means for engaging the outer side of the knife body and determining the position of the knife with respect to the outer clamping member; and an inner clamping member having at least one mounting surface, wherein the at least one mounting surface contacts the planar surface on the inner side of the knife.

* * * * *